US005205488A

United States Patent [19]

Heusser

[11] Patent Number: 5,205,488

[45] Date of Patent: Apr. 27, 1993

[54] PROCESS AND DEVICE FOR SPRAYING A LIQUID INTERMITTENTLY, ESPECIALLY A LUBRICANT SUSPENSION TO BE SPRAYED UNDER HIGH PRESSURE

[75] Inventor: Willi Heusser, Forch, Switzerland

[73] Assignee: Lonza Ltd., Basle, Switzerland

[21] Appl. No.: 673,799

[22] Filed: Mar. 22, 1991

[30] Foreign Application Priority Data

Mar. 26, 1990 [CH] Switzerland ..... 996/90

[51] Int. Cl.[5] ..... B05B 9/00

[52] U.S. Cl. ..... 239/124

[58] Field of Search ..... 239/590, 124, 127, 570, 239/11; 417/46, 45, 375; 137/563, 569, 883

[56] References Cited

U.S. PATENT DOCUMENTS

| | | | |
|---|---|---|---|
| Re. 27,855 | 12/1973 | Norstud et al. | 239/570 X |
| 679,756 | 8/1901 | Kennedy et al. . | |
| 998,762 | 7/1911 | Faller . | |
| 1,690,669 | 11/1928 | China . | |
| 1,944,273 | 1/1934 | Rutherford | 87/9 |
| 1,987,724 | 1/1935 | Tolman | 83/13 |
| 1,989,507 | 1/1935 | Diescher | 78/103 |
| 2,176,879 | 10/1939 | Bartell | 44/9 |
| 2,234,971 | 3/1941 | Kelso | 80/13 |
| 2,316,571 | 4/1943 | Dunmire et al. | 80/1 |
| 2,588,625 | 3/1952 | Ferner et al. | 117/49 |

(List continued on next page.)

FOREIGN PATENT DOCUMENTS

| | | |
|---|---|---|
| 1270175 | 12/1990 | Canada . |
| 039839 | 2/1981 | European Pat. Off. . |
| 164637 | 5/1985 | European Pat. Off. . |
| 0192037 | 8/1986 | European Pat. Off. . |
| 250881 | 5/1987 | European Pat. Off. . |
| 2450716 | 1/1975 | Fed. Rep. of Germany . |
| 2430249 | 2/1976 | Fed. Rep. of Germany . |
| 2823092 | 6/1978 | Fed. Rep. of Germany . |
| 3429524 | 2/1986 | Fed. Rep. of Germany . |
| 55-103203 | 4/1980 | Japan . |
| 56-9008 | 5/1981 | Japan . |
| 56-145503 | 6/1981 | Japan . |
| 58-116910 | 6/1983 | Japan . |
| 58-48361 | 9/1983 | Japan . |
| 59-18799 | 1/1984 | Japan . |
| 59-224054 | 2/1984 | Japan . |
| 596294 | 3/1978 | Switzerland . |
| 609728 | 3/1979 | Switzerland . |
| 981351 | 12/1982 | U.S.S.R. . |
| 1030405 | 2/1983 | U.S.S.R. . |
| 2036071 | 11/1980 | United Kingdom . |
| 2109271 | 6/1983 | United Kingdom . |
| 2163691 | 3/1986 | United Kingdom . |

OTHER PUBLICATIONS

Chemical Abstract, vol. 102, 102:175011f (1985).

Ritzharteprufer nach Sikkens, Typ 601, Erichsen, pp. 2–4, (1976).

*Primary Examiner*—Andres Kashnikow

*Assistant Examiner*—Kevin Weldon

*Attorney, Agent, or Firm*—Fisher, Christen & Sabol

[57] ABSTRACT

A lubricant suspension is sprayed intermittently under high pressure by spray nozzle (4). Spray nozzle (4) operates like an excess pressure valve, by it opening automatically with the input pressure of the suspension exceeding a threshold value pressure and closing automatically in the case of the input pressure falling short of the threshold value pressure. The suspension is conveyed, without the interposition of a shutoff device, directly by pneumatically driven pump (2) to spray nozzle (4). The pump output pressure is maintained at a pause pressure in the pauses between the spraying intervals, is increased to the spraying pressure to spray the liquid, and is again lowered to the pause pressure at the end of the spraying interval. The pause pressure in this case is calculated so that it is just insufficient in value to open spray nozzle (4). The shutoff element subject to abrasion, previously necessary, between the pump and the spray nozzle becomes unnecessary by the pump pressure control according to the invention. The operating safety is significantly increased and the spraying starts immediately without delay when the pump pressure is increased.

10 Claims, 1 Drawing Sheet

U.S. PATENT DOCUMENTS

| | | | |
|---|---|---|---|
| 2,719,386 | 10/1955 | Johnson et al. | 49/82 |
| 2,735,814 | 2/1956 | Hodson et al. | 252/30 |
| 3,147,767 | 9/1964 | Goss | 239/127 X |
| 3,198,735 | 8/1965 | Lamson | 252/25 |
| 3,213,024 | 10/1965 | Blake et al. | 252/33.3 |
| 3,242,075 | 3/1966 | Hunter | 252/22 |
| 3,315,899 | 4/1967 | Quarve | 239/575 X |
| 3,341,454 | 9/1967 | Chor et al. | 252/22 |
| 3,344,065 | 9/1967 | Gunsheimer et al. | 252/18 |
| 3,384,580 | 5/1968 | Peace | 252/29 |
| 3,388,866 | 6/1968 | Levey | 239/570 X |
| 3,472,770 | 10/1969 | Preston et al. | 252/23 |
| 3,525,692 | 8/1970 | Dodson et al. | 252/29 |
| 3,537,653 | 11/1970 | Jones | 239/570 X |
| 3,549,206 | 12/1970 | Reuter | 302/53 |
| 3,577,754 | 5/1971 | Calmes | 72/45 |
| 3,690,558 | 9/1972 | Tuttle | 239/127 |
| 3,770,634 | 11/1973 | Dodson et al. | 252/29 |
| 3,801,504 | 4/1974 | Stone | 252/23 |
| 3,806,453 | 4/1974 | McDole | 252/22 |
| 3,816,025 | 6/1974 | O'Neill | 239/127 X |
| 3,833,502 | 9/1974 | Leary et al. | 252/49.5 |
| 3,838,048 | 9/1974 | Hedge et al. | 252/12 |
| 3,908,038 | 9/1975 | Nienart et al. | 427/27 |
| 3,918,284 | 11/1975 | Reiley et al. | 72/97 |
| 3,919,158 | 11/1975 | Randell et al. | 260/30.6 |
| 3,944,144 | 3/1976 | Okada et al. | 241/22 |
| 3,983,042 | 9/1976 | Jain et al. | 252/18 |
| 4,022,043 | 5/1977 | Chevet | 72/97 |
| 4,039,337 | 8/1977 | Brown et al. | 106/38.28 |
| 4,050,932 | 9/1977 | Lemmer | 75/211 |
| 4,052,323 | 10/1977 | Feneberger et al. | 252/23 |
| 4,055,025 | 10/1977 | Seese et al. | 51/411 |
| 4,055,503 | 10/1977 | Anselment et al. | 252/12 |
| 4,090,666 | 5/1978 | Peck | 239/15 |
| 4,104,178 | 8/1978 | Jain et al. | 252/90 |
| 4,115,283 | 9/1978 | Needham | 252/12.4 |
| 4,140,834 | 2/1979 | Marcantonio et al. | 428/419 |
| 4,206,060 | 6/1980 | Yamamoto et al. | 252/22 |
| 4,206,061 | 6/1980 | Dodson et al. | 252/29 |
| 4,228,020 | 10/1980 | Papay | 252/29 |
| 4,297,231 | 10/1981 | Kahara et al. | 252/182.1 |
| 4,314,907 | 2/1982 | Defretin et al. | 252/22 |
| 4,321,295 | 3/1982 | Smith-Johannsen | 428/206 |
| 4,333,275 | 6/1982 | Bernot | 51/320 |
| 4,339,897 | 7/1982 | Thompson et al. | 51/436 |
| 4,347,249 | 11/1982 | Mellon | 252/12 |
| 4,351,815 | 9/1982 | Glasstetter et al. | 423/445 |
| 4,357,953 | 11/1982 | Patterson | 137/88 |
| 4,452,169 | 6/1984 | Matsuda | 118/50 |
| 4,454,173 | 6/1984 | Koga | 427/235 |
| 4,456,539 | 6/1984 | Shim | 252/46.7 |
| 4,470,939 | 9/1984 | Schoolcraft | 264/104 |
| 4,482,275 | 11/1984 | Shinozaki et al. | 406/12 |
| 4,490,077 | 12/1984 | Shimada et al. | 406/14 |
| 4,535,812 | 8/1985 | Miller | 137/624.11 |
| 4,575,430 | 3/1986 | Periard et al. | 252/12.6 |
| 4,622,702 | 11/1986 | Allen | 4/255 |
| 4,656,105 | 4/1987 | Kobayashi et al. | 429/192 |
| 4,687,598 | 8/1987 | Varma | 252/518 |
| 4,702,860 | 10/1987 | Kinderov et al. | 252/511 |
| 4,710,307 | 12/1987 | Periard et al. | 252/18 |
| 4,735,734 | 4/1988 | Staub et al. | 252/29 |
| 4,790,263 | 12/1988 | Eckert et al. | 118/317 |
| 4,808,324 | 2/1989 | Periard et al. | 252/23 |
| 4,819,471 | 4/1989 | Cook | 72/214 |
| 4,862,838 | 9/1989 | Hodgkins et al. | 123/41.35 |

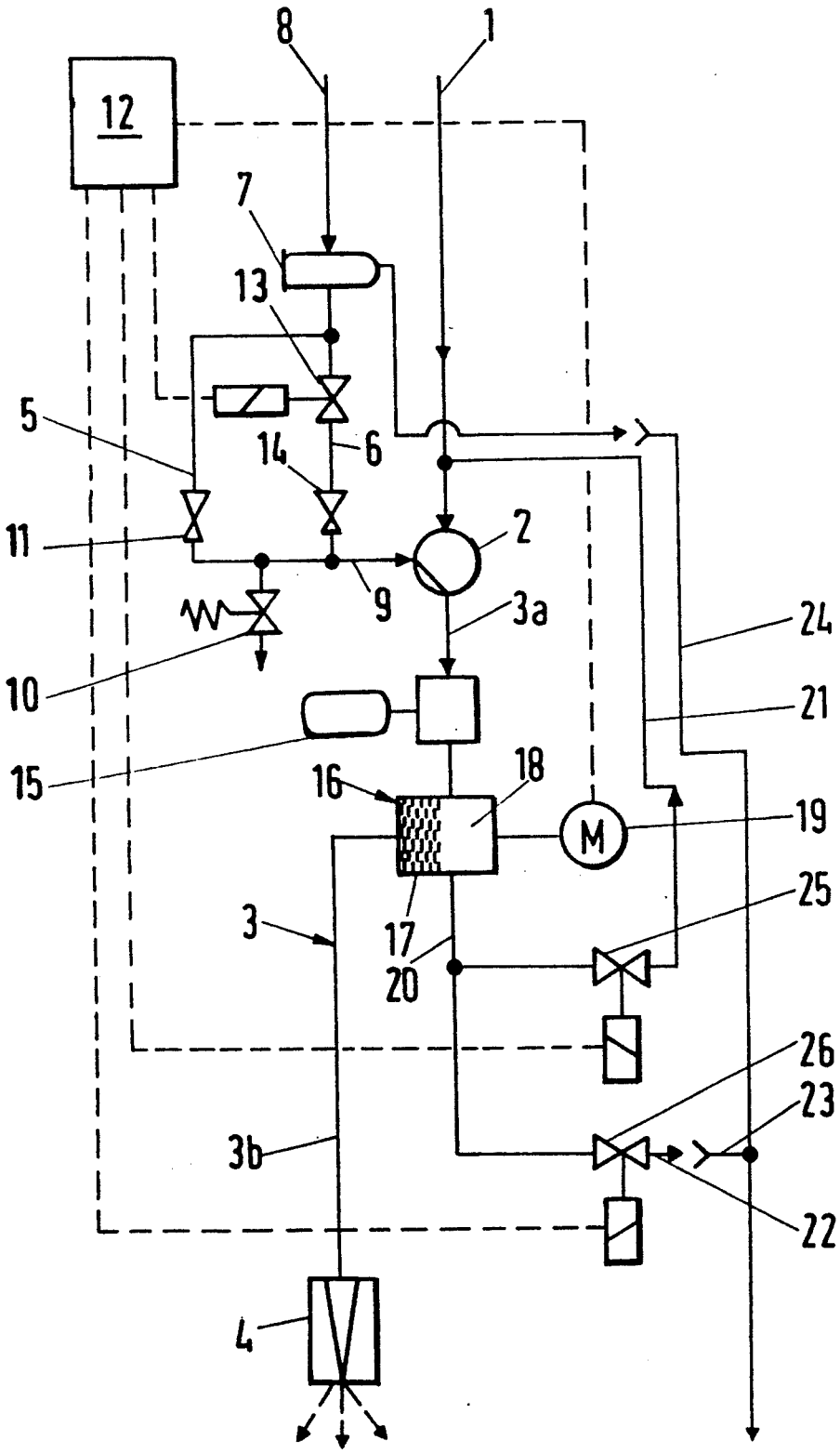
8
1
12
7
13
5
14
6
11
2
9
3a
24
10
21
15
16
18
19
M
25
3
17
20
26
23
3b
22
4

PROCESS AND DEVICE FOR SPRAYING A LIQUID INTERMITTENTLY, ESPECIALLY A LUBRICANT SUSPENSION TO BE SPRAYED UNDER HIGH PRESSURE

BACKGROUND OF THE INVENTION

1. Field of the Invention

The invention relates to a process for spraying a liquid intermittently, especially a lubricant suspension to be sprayed under high pressure, by the spray nozzle which automatically opens like an excess pressure valve when the input pressure of the liquid exceeds the threshold value pressure and, when the inlet pressure of the liquid falls short of the threshold value pressure, automatically closes. The invention also relates to a device, for performing the process, having a spray nozzle which automatically opens like an excess pressure valve when the input pressure of the liquid exceeds the threshold value pressure and, when the inlet pressure of the liquid falls short of the threshold value pressure, automatically closes.

2. Background Art

Processes and devices of the type to which the invention relates are used in particular for the lubrication of mandrel rods in the manufacturing of pipes. In this case, as described, e.g., in European Patent Document No. 0192037, a lubricant suspension, especially a high-temperature lubricant suspension basically containing graphite as well as polymers and auxiliary agents, such as, stabilizers, suspended in water (cf. Swiss Published Patent Document Nos. 596,294 and 609,728) is used which is fed to the spray nozzle under very high pressure of, e.g., 50 to 120 bars (even higher in special cases, up to 250 bars) and with flow rates of 20 to 120 m/sec. As the spray nozzle, as indicated in European Patent Document No. 0192037, one is used Which automatically opens like an excess pressure valve when the input pressure of the liquid exceeds a threshold value pressure and, when the inlet pressure of the liquid falls short of the threshold value pressure, automatically closes, is used, as described, e.g., in European Published Patent Application No. 0039839 (FIG. 2).

For spraying the liquid intermittently, a shutoff device placed in front of the spray nozzle is alternately opened and closed. In the case of high pressures and flow rates, the abrasion, which occurs also and especially in the lubricants which are suitable because of the high velocity of the suspended particles (especially the graphite particles), is critical. As explained in detail in European Patent Document No. 0192037, the shutoff devices have therefore been improved in such a way that they can function, on the one hand, despite the high abrasion over a prolonged period and, on the other hand, leaks are recognized in time so that the entire unit does not have to be shut down in the case of a sudden failure of the shutoff device.

BROAD DESCRIPTION OF THE INVENTION

The main object of the invention is to increase the operating safety of the processes and devices of the above-mentioned type. The achievement of the main object according to the invention follows a path varying basically from the known methods. Other objects and advantages of the invention are set out herein or are obvious herefrom to one skilled in the art.

The objects and advantages of the invention are achieved by the device and process of the invention.

The invention involves a process for spraying a liquid intermittently, especially a lubricant suspension to be sprayed under high pressure, by means of a spray nozzle (4) which automatically opens like an excess pressure valve when the input pressure of the liquid exceeds the threshold value pressure and, when the inlet pressure of the liquid falls short of the threshold value pressure, automatically closes. In the invention process, the liquid is conveyed, without interposition of a shutoff device, directly from a pump (2) to the spray nozzle (4). The pump initial pressure is maintained at a pause pressure in the pauses between the spraying intervals, is increased to the spraying pressure for spraying the liquid and is lowered to the pause pressure again at the end of the spraying interval. The pause pressure is calculated so that it is just insufficient to open the spray nozzle (4).

The invention also involves a device for performing the invention process. The invention device has a spray nozzle (4) which automatically opens like an excess pressure valve when the input pressure of the liquid exceeds the threshold value pressure and, when the inlet pressure of the liquid falls short of the threshold value pressure, automatically closes. In the invention device, a pump (2) is, without interposition of a shutoff device, in constant, direct liquid connection with the spray nozzle (4). There is a pressure control device (11–14), by which the pump output pressure can be increased to the spraying pressure from the pause pressure, which is just insufficient in amount to open the spray nozzle (4), and lowered again.

Instead of a further improvement of the shutoff device, according to the invention the latter is dispensed with entirely and the liquid is conveyed directly by means of a pump to the spray nozzle. The liquid thus is kept in constant, direct liquid connection with the pump. Its initial pressure is maintained in the pauses between the spraying intervals at a pause pressure. The pressure of the liquid is increased for spraying the liquid at the spraying pressure and lowered to the pause pressure again at the end of the spraying interval. The pause pressure is calculated so that it is only just insufficient to open the spray nozzle. Thus, the pause pressure is below the threshold value pressure ("closing pressure") of the automatically closing spray nozzle by a safety tolerance, so that the nozzle is constantly ready to operate and opens immediately when the pump discharge pressure increases.

For the quick lowering of the spraying pressure to the pause pressure, a branch pipe leading away from the pump output pipe is opened preferably at the end of the spraying interval. Via the branch pipe, the liquid optionally is either returned to the pump input pipe or is emptied into a drainpipe leading to a sewer or a filter cake reservoir.

The pump is suitably driven pneumatically and fed by two pneumatic pipes, of which the first pneumatic pump provides the air pressure calculated to produce the pause pressure and of which the second pneumatic pump provides the air pressure calculated to produce the spraying pressure. Preferably both pneumatic pipes are fed in a parallel manner from the same compressed air source; a first pressure regulator limiting the pressure to produce the pause pressure being placed in the first pneumatic pipe; and the second pneumatic pipe having a shutoff element with which, during the pauses, the compressed air supply from the compressed air source is shut off. A second pressure regulator is suitably provided in the second pneumatic pipe so that the spraying pressure can be varied. (The compressed air source determines the spraying pressure without a second pressure regulator.)

Other preferred types of configurations of the invention process and the invention device follow from the original dependent claims and the following description of an embodiment of the invention.

BRIEF DESCRIPTION OF THE DRAWING

The FIGURE is a block diagram of an embodiment of the invention device for intermittently spraying a lubricant suspension.

DETAILED DESCRIPTION OF THE INVENTION

The lubricant suspension is brought into the spraying system by suction by means of pump 2 through section pipe 1. Pump 2 is in constant, direct liquid connection with spray nozzle 4 by means of pump pressure pipe 3 without interconnection with a shutoff device. Spray nozzle 4 is designed like the type of nozzle (FIG. 2) represented in FIG. 2 of European Published Patent Application No. 0039839 so that it opens automatically by means of liquid pressure against the force of a spring, like an excess pressure valve, in the case of the input pressure exceeding a threshold value pressure and closes automatically by means of the spring in the case of the liquid pressure falling short of the threshold value pressure. Pump 2 is a pneumatically-driven (air-powered) 20:1 piston pump (e.g., "King Pump" of the company Graco, Inc.), whose output pressure ("working pressure," pump pressure or feed pressure of the liquid) is almost 20 times the pressure of the compressed air with which pump 2 is fed.

The pump output pressure is increased to a spraying pressure and again lowered for spraying the lubricant suspension intermittently by a pressure control device, described below, in each case by a pause pressure only just insufficient to open spray nozzle 4. For this purpose, pump 2 is connected to two pneumatic pipes 5, 6, of which the first provides the air pressure calculated to produce the pause pressure and of which the second provides the air pressure calculated to produce the spraying pressure. Both pneumatic pipes 5, 6 are connected together on the input side (in a parallel manner) by water separator 7 to compressed air network 8 of the plant, which provides, for example, compressed air with a pressure of 5 bars. On the output side, both pneumatic pipes 5, 6 are connected to feed pipe 9 of pump 2, to which safety valve 10, limiting the pressure to 5 bars, is connected. In first pneumatic pipe 5, there is placed first pressure regulator 11 (pressure regulating valve or pressure reducing valve), which reduces the primary pressure (5 bars) prevailing in the plant system to a secondary pressure of 1.5 bars. On the input side, solenoid valve 13, controlled by electric control device 12, which is used as a shutoff element, and then second pressure regulator 14 (pressure regulating valve or pressure reducing valve) which reduces the primary pressure prevailing in plant system 8 to a secondary pressure of 2.5 bars, are placed in second pneumatic pipe 6. At the secondary pressure of 1.5 bars, the pump output pressure (working pressure) is 30 bars (pause pressure); and at a secondary pressure of 2.5 bars, the pump output pressure is 50 bars (spraying pressure). Spray nozzle 4 opens at an input pressure which is by a tolerance amount greater than the pause pressure of 30 bars.

Pump output pipe 3 (pressure pipe of pump 2) is guided by pressure surge absorber 15 (pulsation absorber, air chamber) and filtering device 16 for spray nozzle 4. Filtering device 16 is used to separate large particles from the suspension. It has antechamber 18 lying in front of filter pad 17 (filtering basket, sieve) in the direction of flow and a wiper driven by motor 19 which, according to the type of wiper usual in pressure filters (e.g., German Patent No. 2,823,092), wipes the filter cake off of each filter pad so that the latter is not clogged. The section of pump output pipe 3 emptying into antechamber 18 in front of filter pad 17 coming from pump 2 (through pressure surge absorber 15) is designated by term 3*a*, and the pipe section conducting the filtrate from filter pad 17 to spray nozzle 4 is designated by term 3*b*.

Branch pipe 20 leads away from antechamber 18, which is branched with first branch 21 leading back to pump input pipe 1 and with second branch 22, which empties into sewer 24 via drain funnel 23, into which the drain of water separator 7 also empties. In each of two branches 21, 22 there is placed a solenoid valve 25, 26, each of which is controlled by electric control device 12. One of solenoid valves 25, 26 is opened in each case at the end of the spraying interval for quick lowering of the spraying pressure to the pause pressure. The intake and the exhaust of antechamber 18 of filtering device 16, to which pump output pipe section 3*a* and branch pipe 20 are connected, are placed on opposite sides of antechamber 18 so that with the opening of solenoid valve 25 or 26 flow is through antechamber 18 and the filter cake contained in front of filter pad 17 and the filter cake parts (large particles) wiped off by the wiper are at least partially swept away into branch pipe 20.

Control device 12 has switches (not shown) and control inputs (not shown) with which the spraying device apparatus can be controlled optionally manually or automatically by control commands from the pipe manufacturing unit. Electric control device 12 is a device which is usual in the prior art and is therefore not described in more detail. Moreover, its mode of operation is evident from the following description of the process performed with the spraying device apparatus represented, and a start is made from the fact that the pipe manufacturing unit provides a starting pulse and a stopping pulse each for the beginning and the end of the spraying interval.

Under readiness conditions of the device, valves 13, 25, 26 are closed. Pump 2 is acted on by the secondary pressure of pressure regulator 11 (fed by compressed air network 8) so that the pump output pressure (pause pressure) is 30 bars and spray nozzle 4, which is acted on by this pressure, remains closed. If control device 12 receives a starting pulse, it sends an opening command to valve 13 so that pump 2 is acted on by the secondary pressure of pressure regulator 14 and its output pressure increases to the spraying pressure (50 bars), and spray nozzle 4 immediately opens with the increase of the pressure, whereupon the lubricant is sprayed. If control device 12 receives a stopping pulse, it gives a closing command to valve 13 and an opening command to valve 25. The pump output pressure therefore immediately drops to the pause pressure whereupon spray nozzle 4 automatically closes. Following the period necessary for the drop of the spraying pressure to the pause pressure (control device 12 has a corresponding timer acted on by the stopping pulse in each case), control device 12 gives a closing command to valve 25. The readiness condition now prevails again.

With a low large particle content of the suspension, as described above, valve 25 is opened in each case so that no suspension is lost and the few large particles that are swept away are conveyed to antechamber 18 again by pump 2. Valve 26 is opened only infrequently in this case, namely, only when a high large particle concentration (a large particle bottom) has formed in the antechamber. (This infrequent opening of valve 26 can automatically take place in each case after a determined number of openings of valve 25 or can be achieved by operating a button.)

In the case of a high large particle content of the suspension, valve 26 is opened suitably more frequently so that the large particles are discharged into the sewer. A too frequent opening of valve 26 naturally is not desirable, since in each case not only the undesired large particles but also (valuable) lubricant is removed.

The described process and the device in particular have the following advantages:

Since pump pressure pipe 3 is maintained in the spraying pauses by pump 2 at the pause pressure only a safety tolerance amount below the threshold value pressure ("closing pressure") of automatically closing spray nozzle 4, an immediate spraying is guaranteed by increasing the pump pressure in this case, the pressure does not first have to be built up to the threshold value pressure.

For the operation of the spraying process the simple small solenoid valve 13, which has only to shut off the compressed air and therefore is subject to no abrasion, is sufficient. In contrast, with the prior art, an expensive multichannel valve was previously necessary to shut off the liquid. Such multichannel valve was exposed to high abrasion because of the high liquid pressure and the high flow rate of the liquid and, therefore, such multichannel valve had to be frequently replaced and the operating safety was impaired.

An immediate pressure relief of pump pressure pipe 3 and, thus, an immediate interruption of the spraying of the liquid is made possible by branch pipe 20 with valves 25, 26, by which not only unnecessary lubricant discharge is avoided but also the danger of accident is reduced. An unintentional spraying of lubricant after completion of the respective work step is dangerous since it is possible that the operation then proceeds to the dangerous (because of the high spraying pressure) spray nozzle area. In addition, at the same time, a flushing and thus a cleaning of filtering device 16 is achieved.

Some variants of the described device and of the process are explained:

Valve 26 can also be a hand-operated shutoff element—thus, the filter cake or the large particle concentrate can be carefully removed by hand and drain funnel 23 can empty into sewer 24 as well as into a collecting tank (a reservoir) so that the filter cake can be fed to a recycling unit.

Valve 25 (just as valve 26) can also be a compressed air-operated valve whose control input is connected by a multichannel valve controlled by control device 12 to compressed air network 8, with which very short switching times can be attained.

A flowmeter, which measures the flow of the suspension, connected to control device 12, can be provided in pump pressure pipe 3. The control device has a monitoring circuit which, during the spraying (during the time of opening of valve 13), shows a deviation of the measured flow from a desired flow and/or gives a warning signal in the case of a deviation exceeding a tolerance level or value. For the same purpose a proximity switch connected to control device 12 can be provided on pump 2 that reports the pump strokes to device 12, and whose monitoring switch examines whether the pump strokes signaled per time unit fall short of a limit and, if so, emits a warning signal showing the faulty working of pump 2.

Pressure gauges can be provided in pipes 3, 5, 6 to check the pipe pressure.

Advantageously, a pressure gauge in particular is placed in pipe 3. The pressure gauge is connected to control device 12. The pressure gauge signals a pressure drop below the pause pressure (if valve 25 or 26 remains open too long) and control device 12 immediately closes valve 25 or 26 in case the pressure falls short of the pause pressure, provided that the user does not stop this automatic closing of valve 25 or 26 by operating a special valve opening button (not shown) for valve 25 or 26. (The valve opening button is pressed for a thorough cleaning of the filtering device.)

A non-return valve (or a non-return flap) can be placed in the direction of flow behind pressure regulator 11 so that the compressed air of pressure regulator 14 (in the case of opened valve 13) cannot act on pressure regulator 11.

The two pressure regulators 11, 14 can also regulate to higher secondary pressures, the first one, for example, to 2.0 bars and the second to 3 bars, so that the pause pressure is 40 bars and the spraying pressure is 60 bars, and spray nozzle 4 of course has to open first at a correspondingly higher input pressure (by a tolerance less than 40 bars). Moreover, for the measurement of the threshold value pressure of spray nozzle 4, a possible drop in pressure in pipe 3 is to be taken into consideration, which has been found to be negligible in the above-described embodiment but should be watched in case of a long pipe with a narrow cross section.

Motor 19 suitably remains continuously in operation, but it can also be turned off by the control device in the case of prolonged pauses and only again be put into operation at the next start command.

Depending on the liquid (or suspension) used, filtering device 16 can also be used without a wiper (and motor 19). In this case, it is especially advantageous to place the intake and the discharge of antechamber 18 of filtering device 16, on which the pump output pipe sections and branch pipe 20 are connected, on opposite sides of antechamber 18 directly adjoining filter pad 17 so that when valve 25 or 26 is opened, the liquid flowing through antechamber 18 directly flows along filter pad 17 and sweeps away the filter cake contained in it. (This arrangement is, of course, advantageous also in the case of above-described filtering device 16 with a wiper.)

In the case of liquids which need no filtering, filtering device 16 can, of course, be eliminated. In this case, of course, branch 22 is also eliminated (in the case of valuable liquids), and there remains only branch pipe 20, which in this case leads from pump pressure pipe 3 directly via valve 25 to suction pipe 1. If only an "inexpensive liquid", e.g., water, is to be sprayed, branch 21 can also be eliminated, and branch pipe 20 can lead from pump pressure pipe 3 directly via valve 26 into sewer 24.

What is claimed is:

1. A device for spraying a liquid or suspension, comprising:

a pump (2) having an input (1) and an output (3), a spray means (4) for spraying the liquid or suspension, a filtering device (16) having an input (3a) for the liquid or suspension joining into an antechamber (18), a filter pad or sieve (17) and a filtrate output (3b) laying in the direction of flow behind said filter pad or sieve (17), said antechamber (18) laying in the direction of flow in front of said filter pad or sieve (17) and having a filter cake output (20, 21, 22), and a shutoff means (25, 26) for shutting off said filter cake output (20, 21, 22), said filtering device input (3a) communicating with said pump output (3), said filtrate output (3b) communicating with said spray means (4) and said filter cake output (20, 21, 22) communicating with said pump input (1).

2. The device for spraying a liquid or suspension, comprising:

a pump (2) having an input (1) and an output (3), a spray means (4) for spraying the liquid or suspension, a filtering device (16) having an input (3a) for the liquid or suspension joining into an antechamber (18), a filter pad or sieve (17) and a filtrate output (3b) laying in the direction of flow behind said filter pad or sieve (17), said antechamber (18) laying in the direction of flow in front of said filter pad or sieve (17) and having a filter cake output (20), a shutoff means (25, 26) for shutting off said filter cake output (20), and a drainpipe (22), said filtering device input (3a) communicating with said pump output (3), said filtrate output (3b) communicating with said spray means (4) and said filter cake output (20) communicating with said drainpipe (22).

3. The device according to claim 2 comprising:

a return pipe (21) connected with said pump input (1), said filter cake output (20) further communicating with said return pipe (21), and said shutoff means (25, 26) for shutting off said filter cake output (20) including a first shutoff element (25) in said return pipe (21) and a second shutoff element (26) in said drainpipe (22).

4. The device according to claims 1, 2 or 3, wherein:

said spray means (4) have a spray nozzle (4) including a valve means for automatically opening and closing, respectively, when the input pressure of the liquid or suspension exceeds and falls short respectively of a threshold pressure, and said pump (2) is connected to a pressure control device (11 to 14), by which the pump output pressure can be increased to a spray pressure from a pause pressure, said spray pressure being higher and said pause pressure being lower than said threshold pressure.

5. A device for spraying a liquid or suspension, comprising:

a spray means (4) for spraying the liquid or suspension, said spray means (4) having a spray nozzle (4) including a valve means for automatically opening and closing, respectively, when the hydraulic input pressure of the liquid or suspension exceeds and falls short respectively of a hydraulic threshold pressure, a pump (2) driven pneumatically and adapted to produce a hydraulic pause pressure and a hydraulic spray pressure, said hydraulic pause pressure being lower and said hydraulic spray pressure being higher than said hydraulic threshold pressure, said pump (2) being connected to first and second pneumatic pipe means (5, 6), said first and second pneumatic pipe means (5, 6) being connected in parallel and fed from a common compressed air source (8), said first pneumatic pipe means (5) including a pneumatic pressure reducing means (11) for limiting the pneumatic pressure to a pneumatic pressure calculated to produce said hydraulic pause pressure, said second pneumatic pipe means (6) providing a pneumatic pressure calculated to produce said hydraulic spray pressure, and being provided with a shutoff element (13), and closing of said shutoff element (13) resulting in the providing of said hydraulic pause pressure and, hence, automatically closing said valve means of said spray means (4) and opening said shutoff element (13) resulting in the providing of said hydraulic spray pressure by said pump and, hence, automatically opening said valve means of said spray means (4).

6. The device according to claim 5 wherein a second pressure regulator (14), which limits the pressure to the pressure desired to produce the spraying pressure, is located in second pneumatic pipe (6).

7. The device according to claim 5, including;

a filtering device (16) having an input (3a) for the liquid or suspension joining into an antechamber (18), a filter pad or sieve (17) and a filtrate output (3b) laying in the direction of flow behind said filter pad or sieve (17), said antechamber (18) laying in the direction of flow in front of said filter pad or sieve (17) and having a filter cake output (20, 21, 22), a shutoff means (25, 26) for shutting off said filter cake output (20, 21, 22), and a hydraulic input and a hydraulic output of said pump (2), said filtering device input (3a) communicating with the hydraulic output (3a) of said pump (2) and said filtrate output (3b) communicating with said spray means (4).

8. The device according to claim 7 wherein said filter cake output (20, 21, 22) communicates with the hydraulic input (1) of said pump (2).

9. The device according to claim 7 including:

a drainpipe (22), and said filter cake output (20) communicating with said drainpipe (22).

10. The device according to claim 9 including:

a return pipe (21) connected with said hydraulic input (1) of said pump (2), said filter cake output (20) further communicating with said return pipe (21), and said shutoff means (25, 26) for shutting off said filter cake output (20) including a first shutoff element (25) in said return pipe (21) and a second shutoff element (26) in said drainpipe (22).

* * * * *